United States Patent [19]

Mark

[11] 4,323,955

[45] Apr. 6, 1982

[54] LIGHT WITH 360° ROTATABLE COVER

[76] Inventor: Edward H. Mark, U.S. 31 North, Niles, Mich. 49120

[21] Appl. No.: 170,857

[22] Filed: Jul. 21, 1980

[51] Int. Cl.[3] ..... F21V 1/10

[52] U.S. Cl. ..... 362/278; 362/223; 362/225; 362/235; 362/280; 362/307; 362/310; 362/311; 362/320; 362/349; 362/360; 362/361

[58] Field of Search ..... 362/278, 223, 225, 280, 362/307, 310, 311, 320, 349, 360, 361

[56] References Cited

U.S. PATENT DOCUMENTS 3,388,246 6/1968 Bailey ..... 362/278

4,233,651 11/1980 Fabbri ..... 362/319

*Primary Examiner*—Benjamin R. Padgett

*Assistant Examiner*—Irwin Gluck

*Attorney, Agent, or Firm*—Oltsch, Knoblock & Hall

[57] ABSTRACT

A lighting facility which includes spaced parallel end plates having a light assembly extending therebetween. A flexible cover extends between and is supported by the end plates so as to be rotatable entirely about the light assembly.

3 Claims, 9 Drawing Figures

LIGHT WITH 360° ROTATABLE COVER

SUMMARY OF THE INVENTION

This invention relates to a lighting facility adapted for suspension and will pertain to a lighting fixture having an adjustable hood or cover.

In the lighting facility of this invention spaced end plates support a light assembly which extends therebetween and serves as a brace. The end plates carry and support a flexible cover or roll hood which is fitted into a groove in the face of each end plate. The flexible cover is rotatable entirely about the light assembly within the end plate grooves and is preferably formed in two pieces so as to allow illumination from the top of the light assembly only, from the bottom of the light assembly only or from a combination of the top and bottom of the light assembly. The cover may also be positioned to direct the illumination in any combination of angles about the 360° arc formed by the continuous grooves in the end plates.

Accordingly, it is an object of this invention to provide a lighting facility which can be utilized optionally for either task or ambient lighting.

Another object of this invention is to provide a lighting facility having a flexible cover which is rotatable entirely about the light source for the facility.

Still another object of this invention is to provide a multiple purpose suspended lighting facility of simple and efficient operation.

Other objects of this invention will become apparent upon a reading of the invention's description.

BRIEF DESCRIPTION OF THE DRAWINGS

A preferred embodiment of this invention has been chosen for purposes of illustration wherein.

DESCRIPTION OF THE PREFERRED EMBODIMENT

Figure 1:
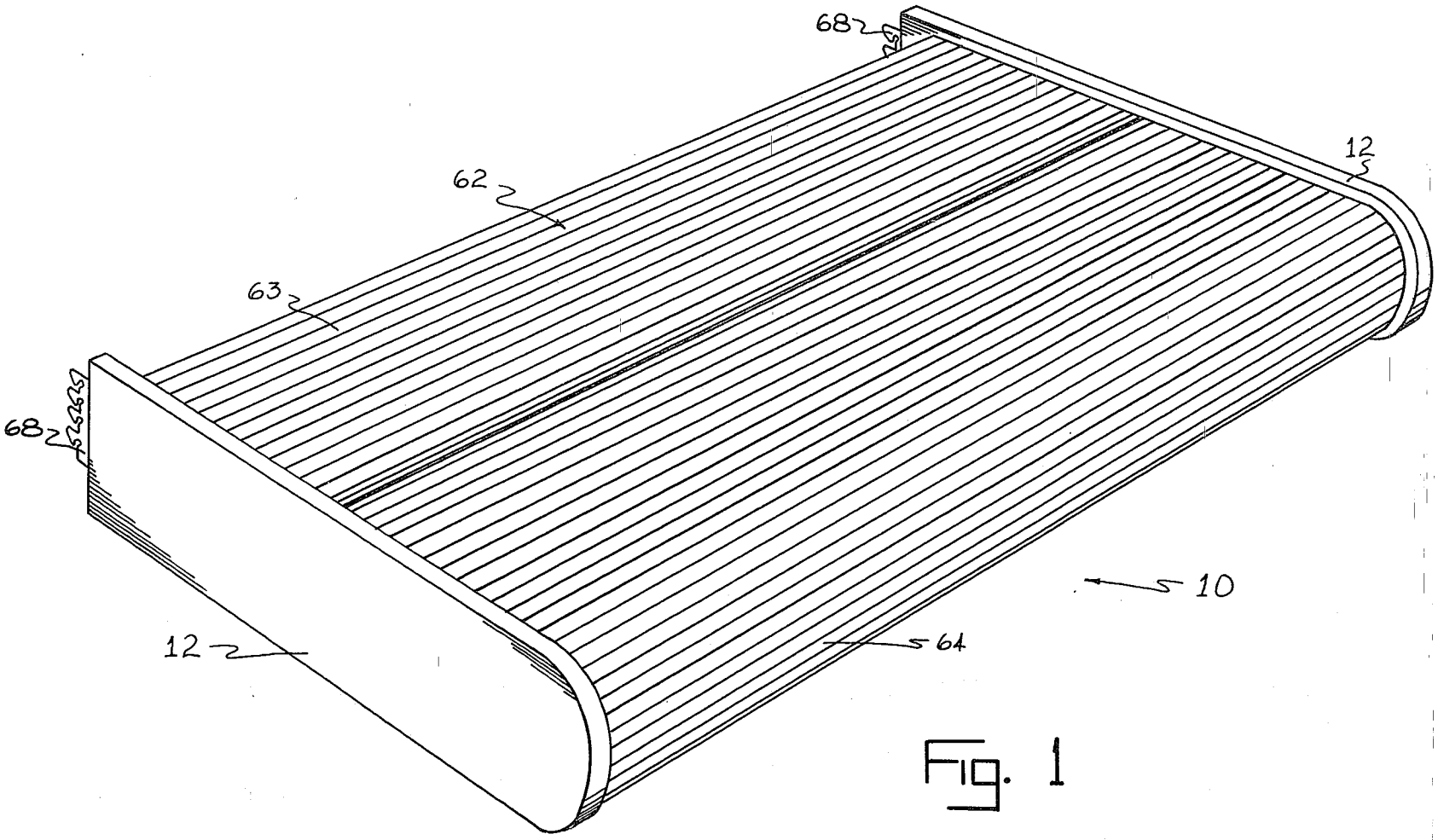
FIG. 1 is a top perspective of the lighting facility in a full task lighting mode.
Figure 2:
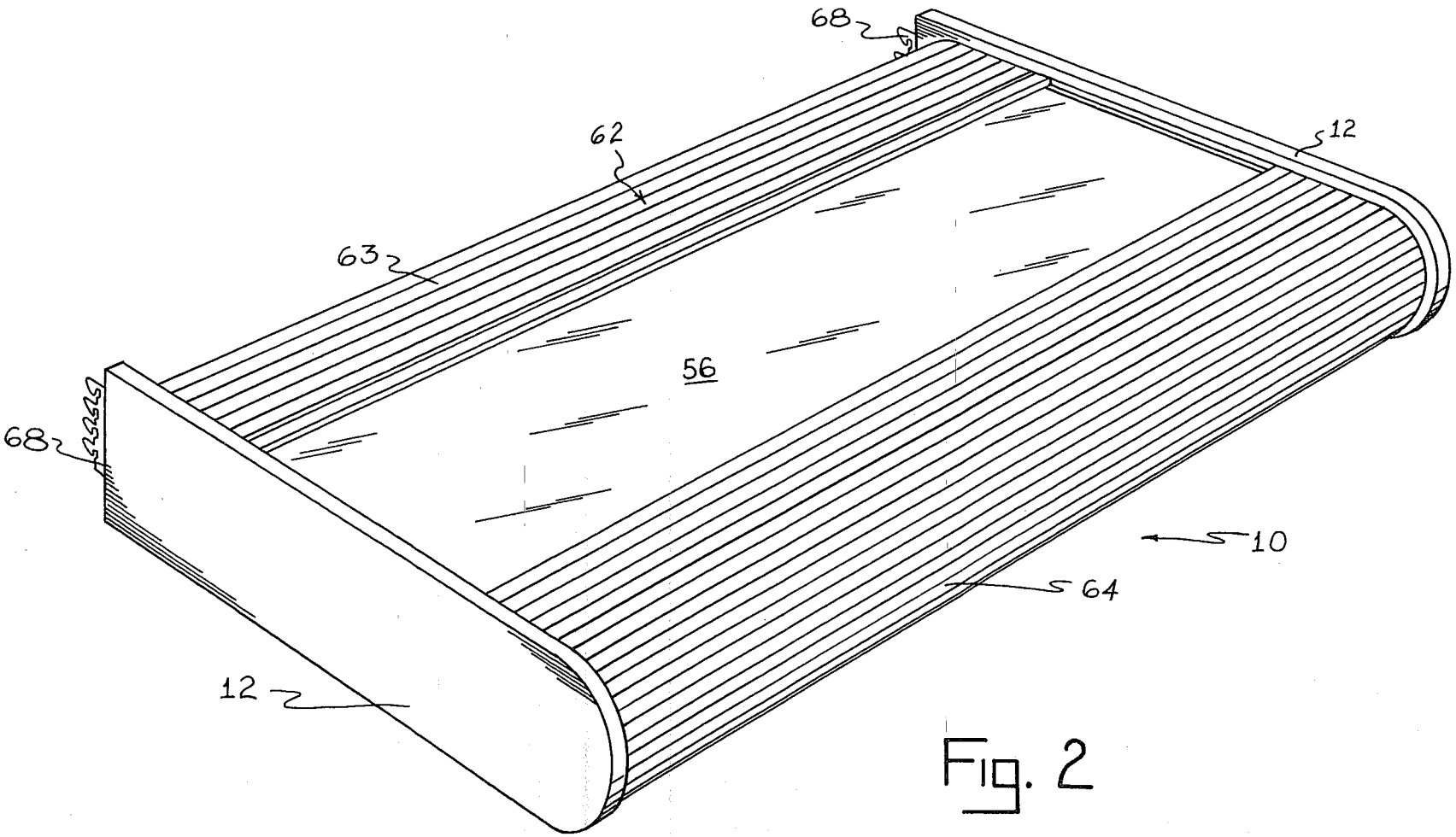
FIG. 2 is a top perspective view of the lighting facility in a combination task and ambient lighting mode.
Figure 5:
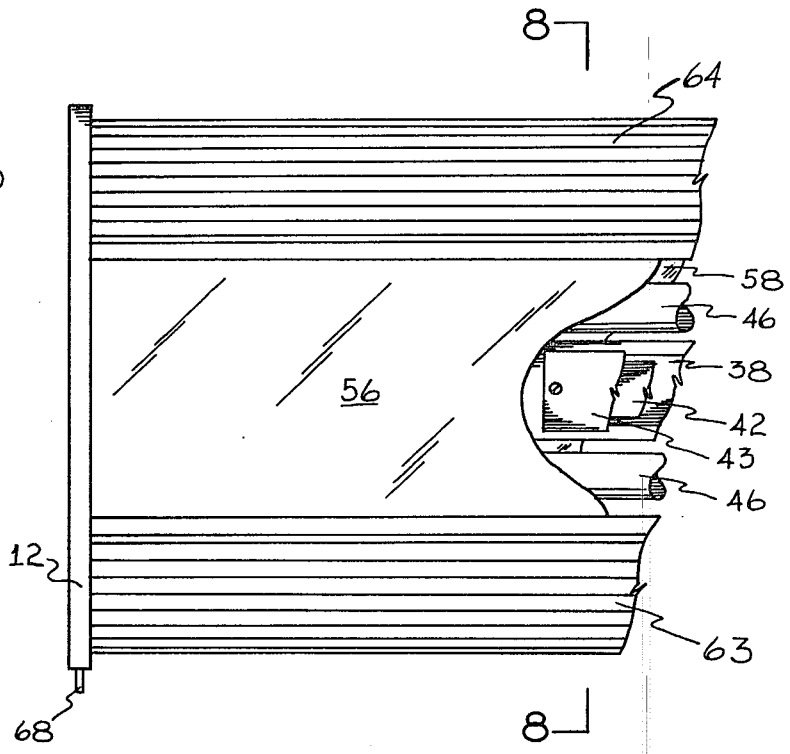
FIG. 5 is a fragmentary plan view of the lighting facility in a combination task and ambient lighting mode.
Figure 4:
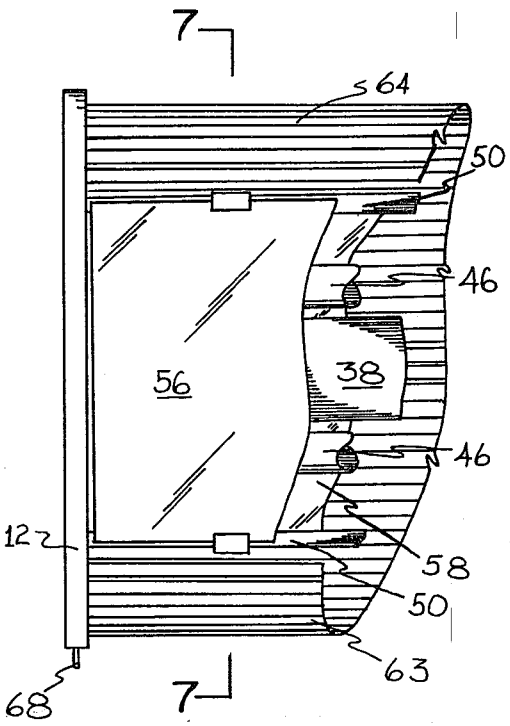
FIG. 4 is a fragmentary plan view of the lighting facility in its full ambient lighting mode.
Figure 3:
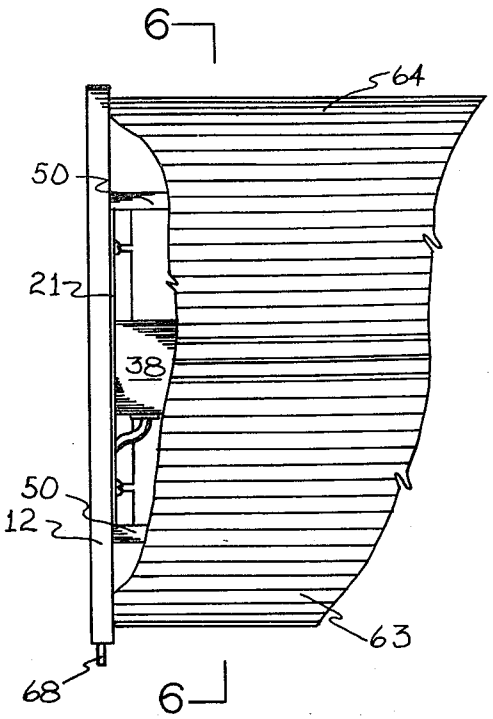
FIG. 3 is a fragmentary plan view of the lighting facility in its full task lighting mode with portions cut away for purposes of illustration.

The preferred embodiment illustrated is not intended to be exhaustive or to limit the invention to the precise form disclosed. It is chosen and described in order to explain the invention and its application and practical use to enable others skilled in the art to best utilize the invention.

Lighting facility 10 includes a pair of laterally spaced, parallel end walls or plates 12 interconnected by a subassembly 14. End plates 12 each have a continuous groove 16 formed on its inner face 18. Groove 16 generally parallels in a spaced relationship the edge 20 of each plate 12.

Figure 6:
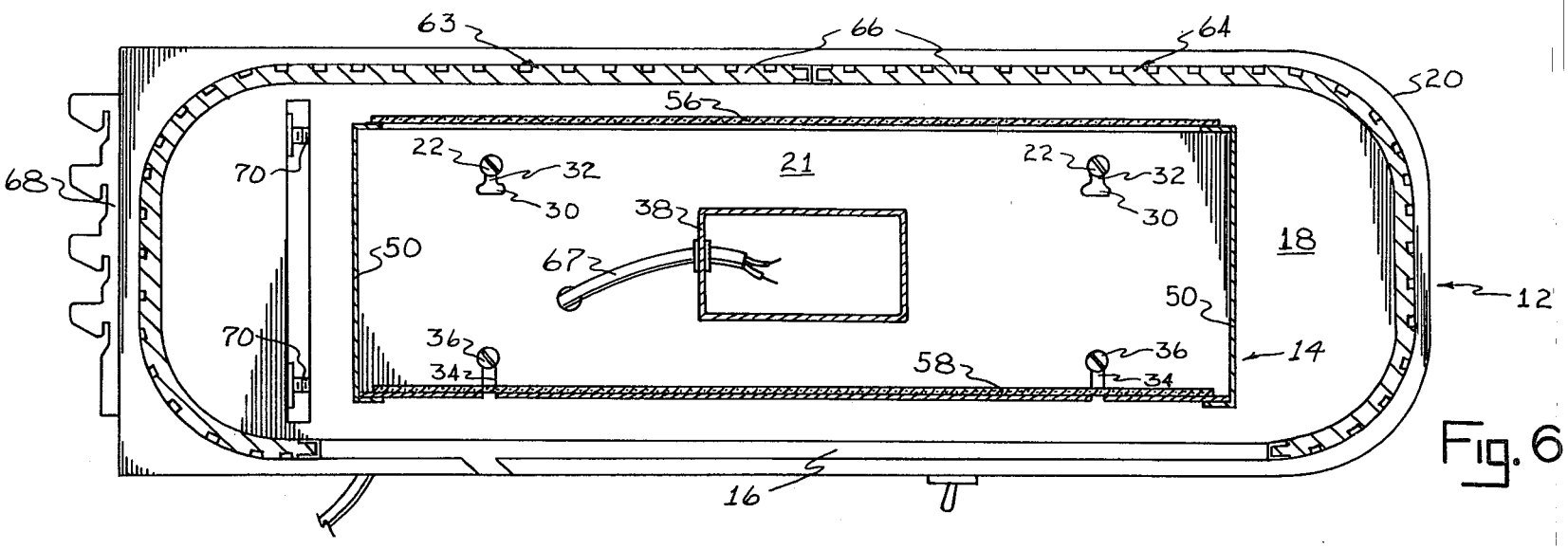
FIG. 6 is a cross sectional view taken along line 6—6 of FIG. 3.
Figure 9:
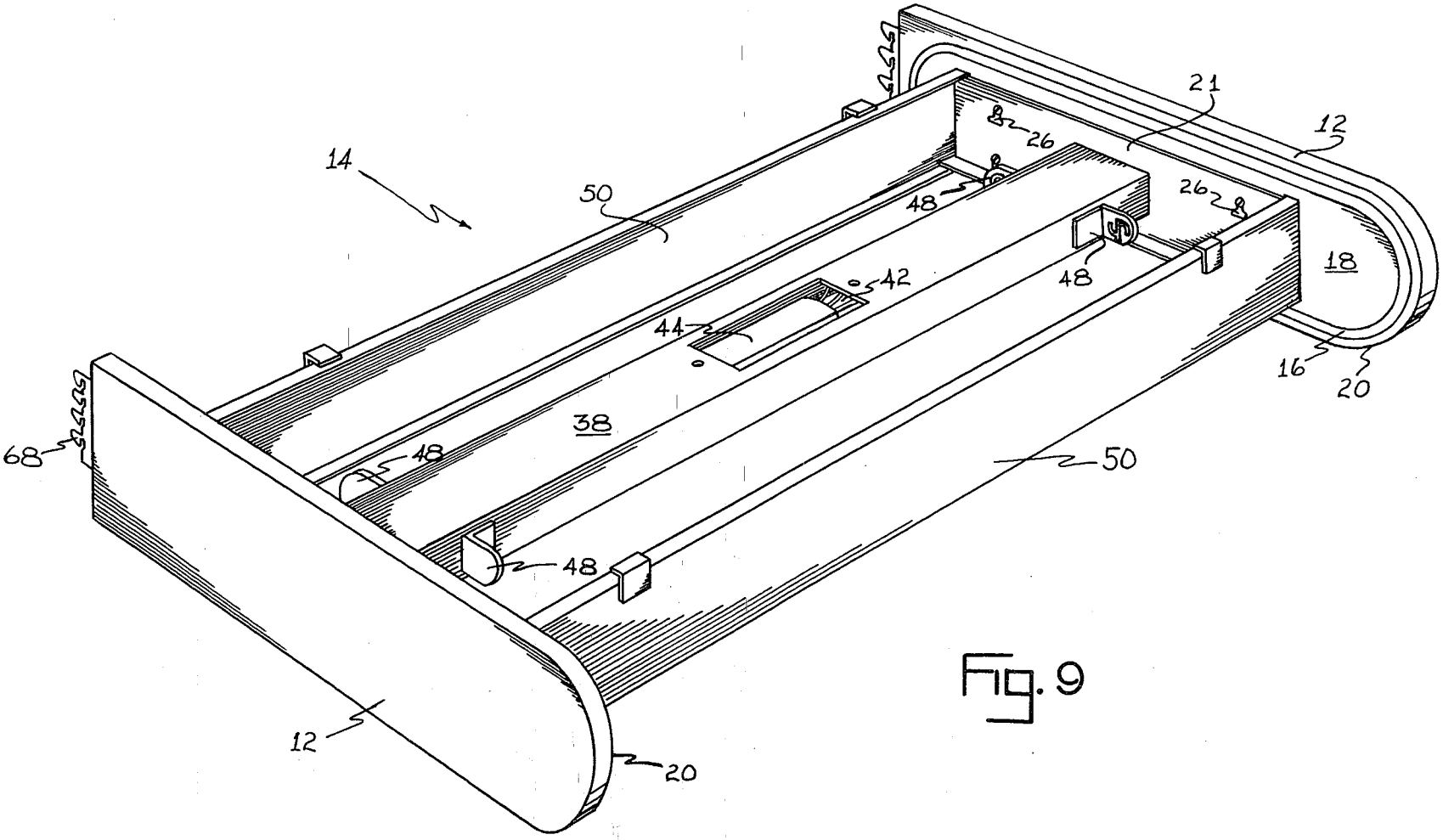
FIG. 9 is a top perspective of the lighting facility with the flexible cover and diffusers removed for purposes of illustration.

Mounting plates 21 of subassembly 14 are connected to the inner face 18 of end plates 12 by screws 22 or similar fastener means. The mounting plates 21 are located within that area of each inner side face 18 of end plates 12 that is circumscribed by groove 16, as best seen in FIG. 6 and FIG. 9. Notches 26 as seen in FIG. 9 are formed in mounting plate 21 so as to allow the heads of screws 22 to fit through the lower portion 30 and nest in the upper portion 32 when the mounting plate 21 is in position (see FIG. 6). Positioning notches 34 are also provided for support of mounting plate 21. Another set of screws 36 or similar fastener means is placed so that the screws nest in positioning notches 34 when screws 22 are nested in the upper portion 32 of notches 26. The screws 22 and 36 are turned into the side faces 18 of plates 12 and against plates 21 to anchor the plates to end plates 12.

A hollow tube 38 of subassembly 14 extends between mounting plates 21 and is connected thereto at each end by a tack weld or other similar means. Tube 38 has an opening 42 intermediate its ends which is covered with a cover plate 43. The ballast 44 for flourescent light tubes 46 is installed within the body of tube 38. Fixture sockets 48 are attached to the side of tube 38 and are spaced intermediate the ends of tube 38 to accommodate proper attachment of flourescent tubes 46. Opaque side plates 50 extend between mounting plates 21 at the front and back of lighting subassembly 14. Mounting plates 21 and side plates 50 form a rectangularly shaped body. A light diffuser 56 extends between plates 21 at the top of subassembly 14. A similar light diffuser 58 extends between plates 21 at the bottom of subassembly 14.

A flexible cover 62 extends between end plates 12. Cover 62 is supported by plates 12 with its end edges fitting guidably within grooves 16 in the end plates 12. With grooves 16 extending entirely about the peripheral edges of end plates 12, the cover 62 may be rotated 360° about subassembly 14. Cover 62 is preferably formed in two independently rotatable parts 63, 64. Each cover part 63, 64 may be formed of a plurality of interconnected slats 66 or of a flexible shape-retaining material. Suitable wiring 67 connects ballast 44 and fixture sockets 48 to a current source. Lighting facility 10 may be connected to a wall or similar vertical support with the aid of catch brackets 68 connected to end plates 12 by bolts 70.

Figure 7:
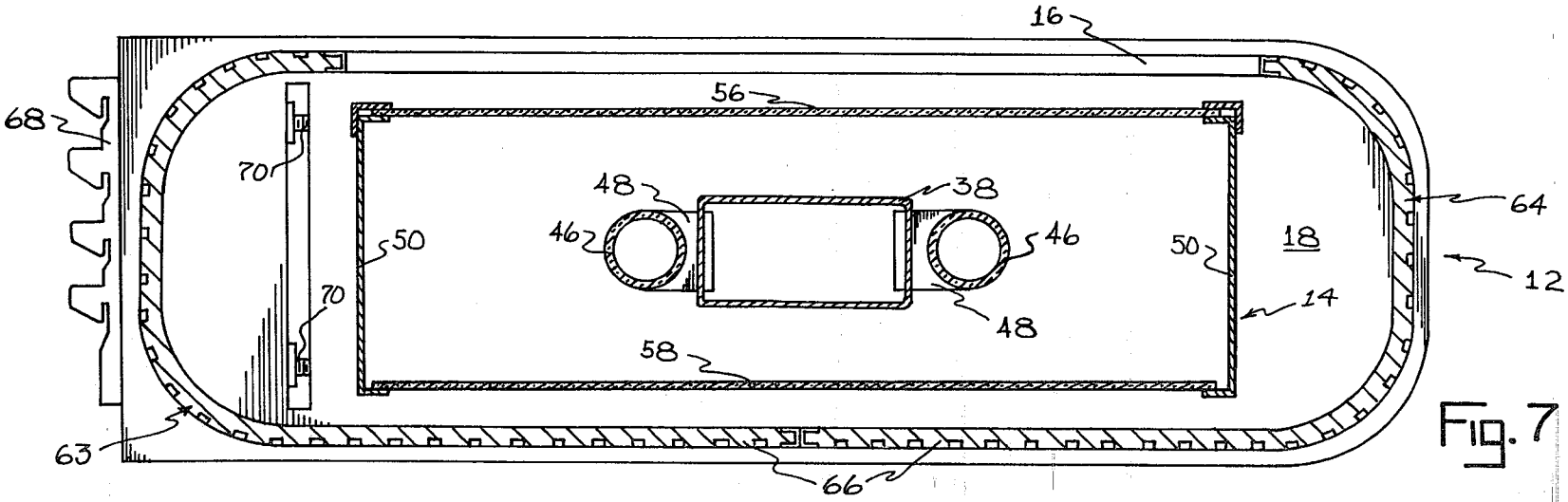
FIG. 7 is a cross sectional view taken along line 7—7 of FIG. 4.
Figure 8:
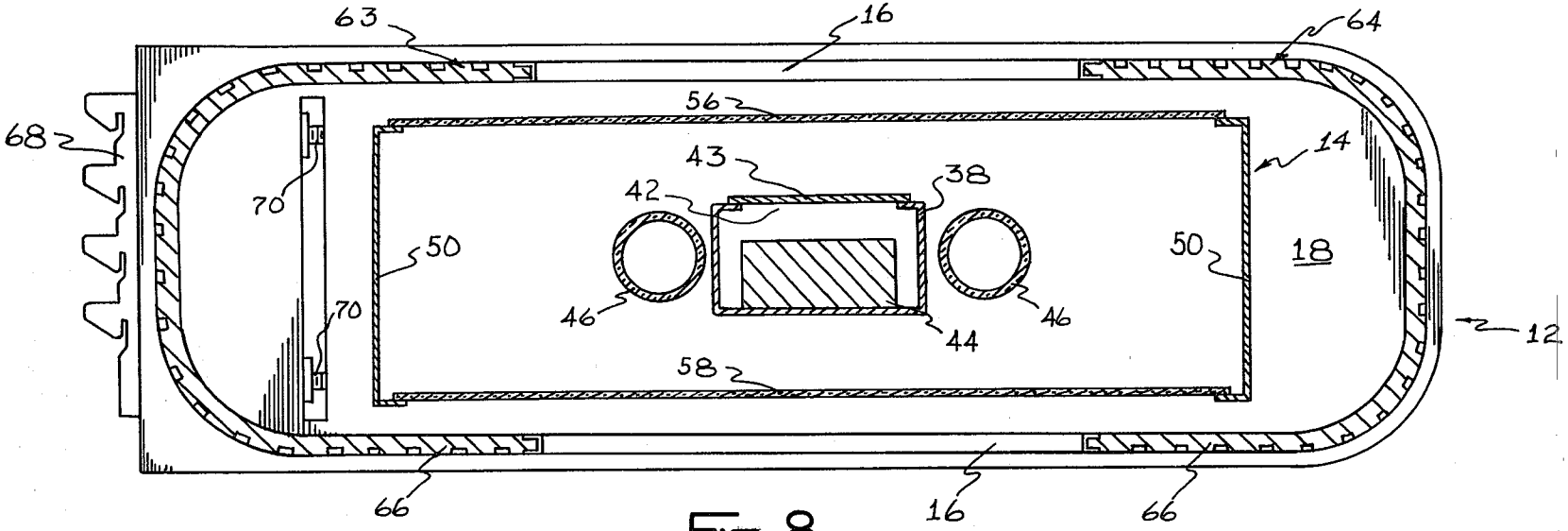
FIG. 8 is a cross sectional view taken along line 8—8 of FIG. 5.

Lighting facility 10, as above described, can be utilized in a variety of ways such as for ambient lighting, task lighting or both. The cover parts 63, 64 can be closed at the top as illustrated in FIG. 6 to provide task lighting with the light being directed downwardly through diffuser 58. FIG. 7 illustrates the fully ambient mode where parts 63, 64 are closed at the bottom of the lighting facility 10 with the light being directed upwardly through diffuser 56. The combination task and ambient mode is illustrated in FIG. 8 which shows cover parts 63, 64 separated at the top and the bottom of the lighting facility 10. As will be obvious, cover parts 63, 64 can be rotated to any 360° position about lighting subassembly 14 to direct the light from tubes 46 in any desired direction.

It is understood that the invention is not to be limited to the details above given, but may be modified within the scope of the appended claims.

What I claim is:

1. A lighting facility comprising a pair of spaced end plates having opposing side faces, a subassembly extending between said end plates from one side face to the other side face thereof, said subassembly including a light source, each end plate having a peripheral groove formed in its said side face circumscribing said subassembly at the end plate, a flexible cover extending between said end plates and including edges each fitted within a said groove, each groove constituting guide means wherein said cover can be rotated about said light source to various operative positions, said cover constituting means to control the direction of light from said light source when rotated about the source.

2. The lighting facility of claim 1 wherein said cover is of a two part construction, said parts being independently rotatable within said guide means about said light source.

3. The lighting facility of claim 1 and means connected to said end plates for supporting the end plates in a suspended orientation.

* * * * *